United States Patent [19]

Zabar

[11] Patent Number: 4,916,425

[45] Date of Patent: Apr. 10, 1990

[54] ELECTROMAGNETIC DEVICE

[76] Inventor: Nachum Zabar, 4 Ravon Street, Givat Savion, Ganeh Tikvah, Israel

[21] Appl. No.: 238,867

[22] Filed: Aug. 31, 1988

Related U.S. Application Data

[63] Continuation-in-part of Ser. No. 937,673, Oct. 10, 1986, abandoned.

[30] Foreign Application Priority Data

Apr. 22, 1986 [IL] Israel ..... 78573

[51] Int. Cl.[4] ..... H01F 17/00; H01F 27/24; H01F 27/28

[52] U.S. Cl. ..... 336/177; 336/180; 336/188; 336/212; 336/223

[58] Field of Search ..... 336/177, 180, 182, 184, 336/188, 229, 223, 212, 222

[56] References Cited

U.S. PATENT DOCUMENTS

| | | | |
|---|---|---|---|
| 2,199,116 | 4/1940 | Sanders | 336/219 X |
| 2,716,736 | 8/1955 | Rex | 336/177 X |
| 2,997,667 | 8/1961 | Gilbent | 336/177 X |
| 3,247,476 | 4/1966 | Pintell | 336/177 |
| 4,060,784 | 11/1977 | Fergestad | 336/177 X |
| 4,356,468 | 10/1982 | van Laar | 336/177 X |

FOREIGN PATENT DOCUMENTS

| | | | |
|---|---|---|---|
| 45-7883 | 6/1967 | Japan | 336/177 |
| 1315659 | 5/1973 | United Kingdom | 336/177 |

*Primary Examiner*—Thomas J. Kozma
*Attorney, Agent, or Firm*—Larson and Taylor

[57] ABSTRACT

An electromagnetic device, comprising a first, ring-shaped wound unit consisting of at least first and a second sequentially wound portions of electrically insulated layers of concentrically wound windings, the first portion being made of high permeability material, the second portion being made of a relatively low resistance electrical current-carrying material, the first and second portions being electrically connected to each other and provided with terminal means for connection to a source of power, whereby in operation each of the units constitutes a current conducting as well as an electromagnetic field inducing body for the other of the interlinked units.

12 Claims, 2 Drawing Sheets

ELECTROMAGNETIC DEVICE

This application is a continuation-in-part of application Ser. No. 937,673, now abandoned, filed Oct. 10, 1986, now abandoned.

The present invention relates to an electromagnetic device and more particularly, the present invention is concerned with electromagnetic devices such as transformers, chokes, relays, electromagnets and the like.

Electromagnetic devices of the kind specified above comprise two basic, structurally and functionally distinct components: a core usually made of iron or steel bodies and one or more windings usually made of enameled copper wires. The tasks of these components are completely different as the copper wire is designed to efficiently pass the electrical current applied thereto, while the core is designed to transfer the electromagnetic flux induced by the current.

In contradistinction to the above commonly used electromagnetic devices, it is an object of the present invention to provide electromagnetic devices in which the two components are interchangeable and each in its turn fulfills the two tasks. Accordingly, while the two components need not necessarily be identical or even of a similar configuration, each of the components must be adapted to both, pass electrical current and constitute an electromagnetic flux induced media for the other component.

In accordance with the present invention there is therefore provided an electromagnetic device, comprising a first, ring-shaped wound unit consisting of at least first and a second sequentially wound portions of electrically insulated layers of concentrically wound windings, said first portion being made of high permeability material, said second portion being made of a relatively low resistance electrical current-carrying material, said first and second portions being electrically connected to each other and provided with terminal means for connection to a source of power, whereby in operation each of said units constitutes a current conducting as well as an electromagnetic field inducing body for the other of said interlinked units.

The term ring-shaped wound element as used herein is intended to describe and define toroidal, oval, square, rectangular or the like shaped elements.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
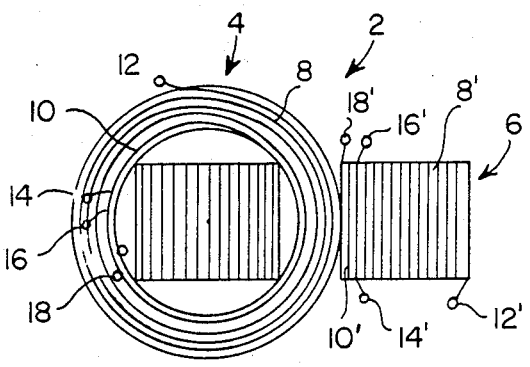
FIG. 1 is a cross sectional view of a basic device comprised of two interlinked units according to the present invention.

Referring to FIG. 1, there is illustrated a first basic embodiment of an electromagnetic device 2 according to the present invention showing two ring-shaped wound units 4 and 6 each made of two sequential ferromagnetic coincentric electrically insulated, layered windings 8 and 10, and respectively, windings 8' and 10'. Windings 8,8' are made of a high permeability material, such as, iron or cold-rolled steel band, while windings 10,10' are made of relatively low resistance material, such as, copper or aluminum. The two units 4 and 6 are interlinked in a chain-like manner and may be electrically interconnected as shown in FIGS. 2 to 5 by means of their terminals 12, 14, 16 and 18 of unit 4 and, respectively, 12', 14', 16' and 18', of unit 6.

Figure 2:
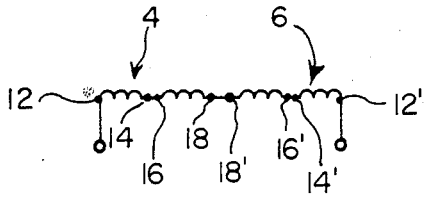
FIGS. 2 to 5 are electrical circuit diagrams showing four different ways of electrically interconnecting the two units of FIG. 1.
Figure 3:
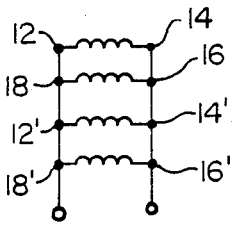
Figure 4:
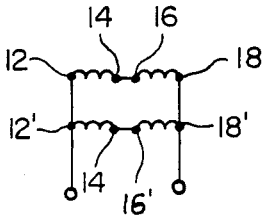
Figure 5:
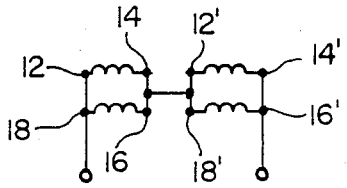

In FIG. 2 there is illustrated a simple series connection between the windings 8,8' and 10,10' cord between the units 4 and 6, while in FIG. 3 there is shown a parallel electrical interconnection between the undivided windings and the two units 4 and 6. In FIGS. 4 and 5 there is shown combined series and parallel elecrical interconnections.

The number of turns of each of the windings 8,8' and 10,10' in each of the units 4 and 6 is a matter of, per-se, known calculations considering, inter alia, the expected power, and the exact nature of the ferromagnetic materials of the windings.

In practice, when the device is connected to a source of voltage, current will flow in both windings 8 and 10, and respectively, 8' and 10' of each unit in the same direction and the flow of current in one unit will induce in the interlinked, other unit, a corresponding flux oriented in the direction of the current flow therein.

Figure 6:
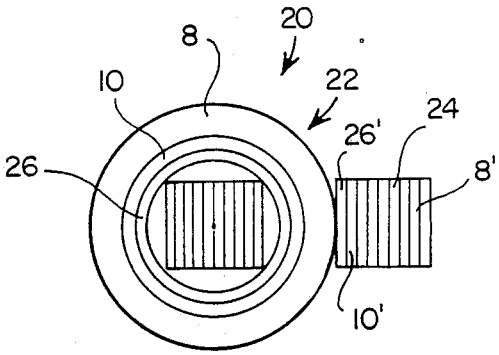
FIG. 6 is a cross-sectional view of a further embodiment of a device according to the present invention.
Figure 7:
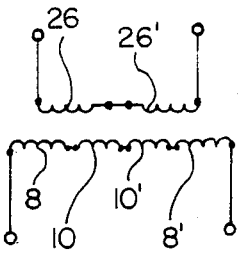
FIG. 7 is an electrical circuit diagram showing a possible electrical interconnection of the device of FIG. 6.

Referring to FIGS. 6 and 7 there is shown a transformer device 20 including the interlinked units 22 and 24 and each having in addition to windings 8 and 10, and respectively 8' and 10', also a further contiguous winding 26 and respectively 26', made of copper or aluminum and constituting the secondary of the transformer device. Each unit thus fulfills three functions: the conduction of current; the conduction of flux; acting as a primray or as a secondary of a transformer. Thus, the structure of such a transformer device contains the advantges of the concentrically wound, current carrying as well as magnetic field induced unit as outlined above.

Figure 8:
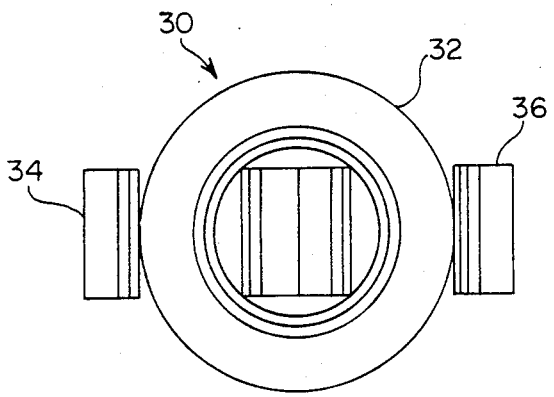
FIG. 8 is a cross-sectional view of a three unit device according to the present invention.
Figure 9:
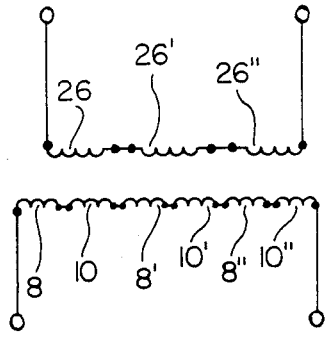
FIG. 9 is an electrical circuit diagram of the electrical interconnections of the units of FIG. 8.

In FIGS. 8 and 9 there is illustrated a transformer device 30 composed of three interlinked units 32, 34 and 36, each including thre concentrically wound windings 8,10,26, 8',10',26' and 8'',10'', 26''. Hence, in contradistinction to the commonly used transformers, where each element fulfills a single function only, namely, a transformer built usually of a primary copper winding and of a secondary copper winding for the sole purpose of current conduction and a ferromagnetic core element, merely providing a medium for conduction of magnetic flux, in accordance with the present invention, each unit of the transformer fulfills the function of a current carrying winding as well as that of a magnetic flux induced core. Obviously, the windings 26,26',26" referred to as secondary windings, can constitute primary windings as well, depending on the type of transformer used, namely, whether the transformer is a step up or a step down transformer.

Figure 10:
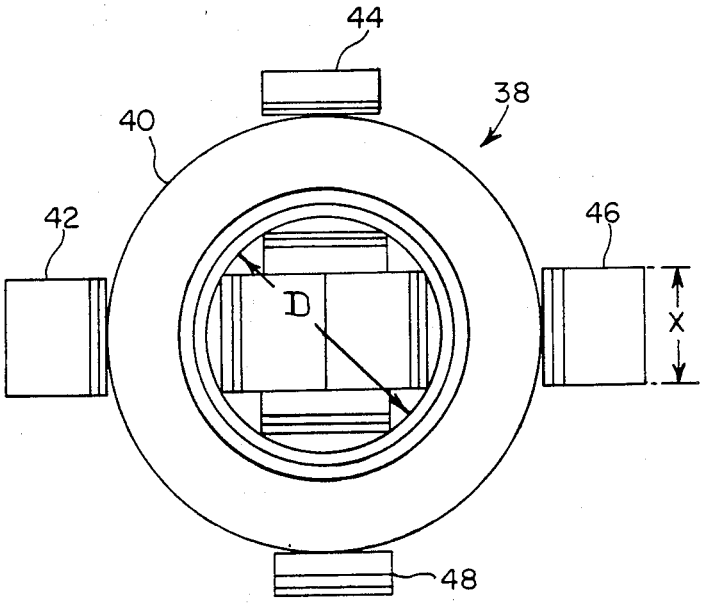
FIG. 10 is a cross-sectional view of a five unit device according to the present invention.

Turning now to FIG. 10, there is illustrated a proposed configuration of an efficient transformer device 38 consisting of five interlinked units 40, 42, 44, 46 and 48 each of the type hereinbefore described with reference to the previous figures. It has been calculated, that in order to achieve a satisfactory efficiency of the transformer, the dimension x of at least the part of the units disposed inside the unit 40, should be 0.52573.D, where D is the inside diameter of the units. Naturally, a four unit configuration where three units link a central unit in a 120° angular displacement, is also contemplated.

The spaces which are left unoccupied by the interlinked units 42, 44,46 and 48 inside the unit 40, may be filled in by further windings, which further windings may be made of copper or other material.

Figure 11:
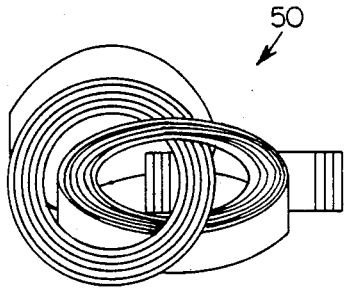
FIG. 11 is an isometric and cross-sectional view of still a further embodiment of the present invention.

While in the embodiments of FIGS. 8 and 10 there are illustrated certain simple manners of interlinking between units, in FIG. 11 there is illustrated a three unit transformer device 50, interlinking the units in a different fashion, where each unit is interlinked with the two other ones, instead of with only one further unit.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An electromagnetic device, comprising:

first and second ring-shaped wound units interlinked in a chain-like manner, each unit comprising at least first and a second sequentially wound portions of electrically insulated layers of concentrically wound windings;

said first portion being made of high permeability material;

said second portion being made of a relatively low resistance electrical current-carrying material;

said first and second portions being electrically connected to each other and provided with terminal means for connection to a source of power;

whereby in operation each of said units constitutes a current conducting as well as an electromagnetic field inducing body for the other of said interlinked units.

2. The device as claimed in claim 1 wherein said first portion is made of iron.

3. The device as claimed in claim 1 wherein said second portion is made of copper.

4. The device as claimed in claim 1 wherein said first and second portions are electrically interconnected in series.

5. The device as claimed in claim 1 wherein said first and second portions are electrically interconnected in parallel.

6. The device as claimed in claim 1 wherein said first and second portions are electrically interconnected in a combined series and parallel arrangement.

7. The device as claimed in claim 1 wherein there is further provided a third, sequentially wound portion of electrically insulated layers of concentrically wound windings made of a relatively low resistance electrical current-carrying material.

8. The device as claimed in claim 7 wherein said units are electrically interconnected so as to form a transformer.

9. The device as claimed in claim 7 comprising three interlinked units.

10. The device as claimed in claim 7 comprising five interlinked units.

11. The device as claimed in claim 1 wherein said first portion is made of steel.

12. The device as claimed in claim 1 wherein said second portion is made of aluminum.

* * * * *